United States Patent [19]

Ishizu et al.

[11] Patent Number: 4,891,678

[45] Date of Patent: Jan. 2, 1990

[54] ELECTROSTATIC RECORDING APPARATUS HAVING A COOLED AND INSULATED WASTE TONER CONTAINER

[75] Inventors: Hisao Ishizu, Tokyo; Tomobumi Shibano, Kawasaki; Yasuhiro Sagawa, Yamato; Hiroshi Komai, Yokohama, all of Japan

[73] Assignee: Ricoh Company, Ltd., Tokyo, Japan

[21] Appl. No.: 204,273

[22] Filed: Jun. 9, 1988

[30] Foreign Application Priority Data

Jun. 17, 1987 [JP] Japan ..... 62-149168

[51] Int. Cl.[4] ..... G03G 21/00

[52] U.S. Cl. ..... 355/285; 355/298

[58] Field of Search ..... 355/3 R, 3 FU, 14 FU, 355/30, 285, 287, 290, 298; 219/216

[56] References Cited

U.S. PATENT DOCUMENTS 4,540,268 9/1985 Toyono et al. ..... 355/3 R
4,571,056 2/1986 Tani et al. ..... 355/3 FU
4,693,588 9/1987 Yarbrough et al. ..... 355/3 R

*Primary Examiner*—Arthur T. Grimley
*Assistant Examiner*—J. Pendegrass
*Attorney, Agent, or Firm*—Oblon, Spivak, McClelland, Maier & Neustadt

[57] ABSTRACT

An electrostatic recording appartus having a thermally fixing apparatus and an image forming case adapted to accomodate a unit having a toner container disposed adjacent to a thermally fixing apparatus. An open space is provided between the wall of the image forming case and the wall of the toner container. At the upper and lower portions of the open space, vent ports are preferably provided. Heat insulating material is effectively applied to the walls defining the open space.

5 Claims, 2 Drawing Sheets

ELECTROSTATIC RECORDING APPARATUS HAVING A COOLED AND INSULATED WASTE TONER CONTAINER

FIELD OF THE INVENTION AND RELATED ART STATEMENT

The present invention relates to an electrostatic recording apparatus including a thermally fixing means and an image forming case accomodating a unit having a container for toner adjacent to said thermally fixing means.

BACKGROUND OF THE INVENTION

Recently, such electrostatic recording apparatuses as an electro-photo copier, a laser printer and the like have been made more and more compacts and propagation of personal use of such electrostatic recording apparatuses requiers higher reliability in respect of the quality. In an electrostatic recording apparatus, a toner image formed on a photosensitive member in the course of the electrostatic photography process is transferred to a transfer paper which is then thermally fixed to bear a record. After the transfer process, the toner left on the photosensitive member is removed by means of a cleaning blade or a cleaning roller and recovered and stored in a waste toner container.

In a recording apparatus of a compact type, the image forming system mainly consisting of a photo-sensitive member and a thermally fixing apparatus are disposed quite closely to each other. With regard to the material for the respective apparatuses, plastic molded members are frequently utilized in view of reduced cost, light weight and so forth. Furthermore, a consideration has been taken to enable the photo-sensitive member unit including the cleaning apparatus and the developing apparatus to be accomodated in one image forming case which is in turn removed from or attached to the recording apparatus as a unit to make it easy for a user to exchange the unit. It is to be noted, however, that the fixing temperature at the thermally fixing apparatus can not be considerably lowered exceptionally even if the apparatus in question has been made compact due to limitation in fixing characteristics or at most down to the range of 160° C. and 170° C. Naturally those units disposed in proximity to the fixing apparatus will be subjected to the effect by heat. In particular, the waste toner container for the cleaning apparatus has to be located rather near to the fixing apparatus in view of the layout, and the toner in such a waste toner container will get solidified in the form of cake if the temperature goes up abnormally or the so-called caking will be resulted. Consequently, the level detector adapted to detect the level of the surface of toner material in the container will fail in satisfactory operation. As a result, the toner packing generated in the container will cause the toner to overflow from the clearance between the toner cleaning member and the photo-sensitive member, resulting in poor cleaning, deterioration inside the electrostatic recording apparatus, damage to the driving gears and the like problems.

OBJECT OF THE INVENTION

An object of the present invention is to provide a recording apparatus which has solved the problems as above explained with respect to the recording apparatus according to a prior art in which the waste toner container is located adjacent to the thermally fixing apparatus and in which the waste toner container is constructed in such a way that it will be hardly affected by the thermally fixing apparatus.

SUMMARY OF THE INVENTION

In order to attain the objectives as above mentioned, the present invention provides a recording apparatus wherein the image forming case accomodating a unit having a toner container and a thermally fixing apparatus located adjacent to the toner container with the wall of the case there between are provided, the apparatus being characterized in that an open space is provided between the wall of the image forming case and the toner container wall of the unit.

Other features and advantages of the present invention will be apparent from the explanation which follows with reference to the accompanying drawings.

DETAILED DESCRIPTION OF PREFERRED EMBODIMENTS

An embodiment of the present invention will now be explained by referring to the accompanying drawings.

Figure 1:
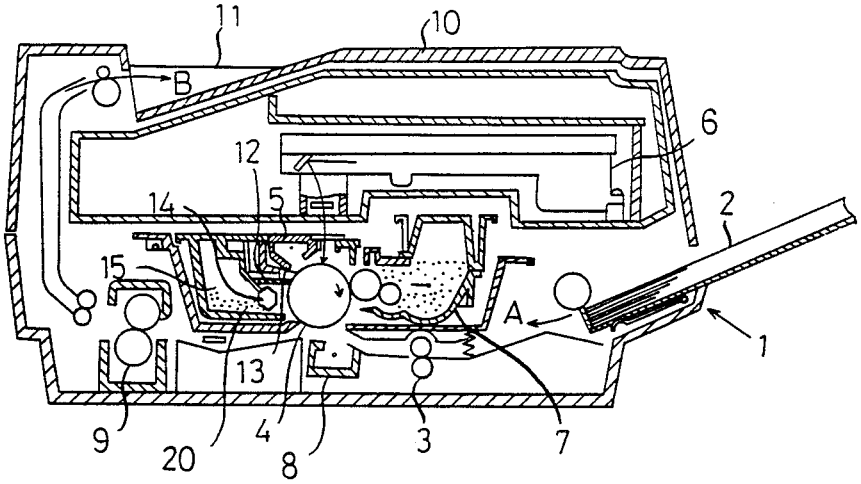
FIG. 1 is a sectional side elevation illustrating the general constitution of an embodiment of the present invention.

FIG. 1 illustrates the general constitution of an embodiment of the present invention as applied to a laser printer of a compact type.

In FIG. 1, recording paper 2 which has been supplied from a supply apparatus 1 of a printer body 10 in the direction designated by an arrow A is provided timing by means of a pair of register rollers 3 and transferred to the transfer portion along a photo-sensitive member drum 4. The photo-sensitive member drum 4 uniformly charged by a charger 5 is exposed to a laser beam containing image information by a laser write optical system 6 so that an electrostatic latent image is formed. This latent image will be developed by the a developing apparatus 7 by the toner to become a toner image, such that the toner image will be transferred to the recording paper 2 by a transfer charger 8. After transfer, the recording paper 2 will be fixed by means of a thermal roller fixing apparatus 9 and discharged to a paper discharge part 11 in the direction designated by an arrow B. On the other hand, the toner which has been left on the photo-sensitive member drum 4 after transfer of the image is then removed by a cleaning blade 12 of a cleaning apparatus 20, and the photo-sensitive member drum 4 is discharged by a discharge brush 13. The waste toner which has been removed by the cleaning blade 12 is recovered by a waste toner container 15 by way of a paddle wheel 14.

Figure 2:
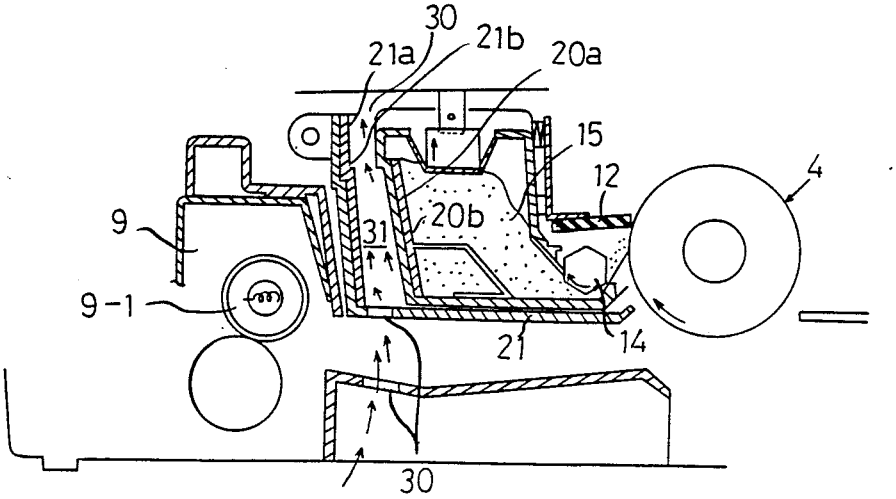
FIG. 2 is a sectional side elevation showing details of the portion adjacent to the cleaning apparatus.

According to the present apparatus, as illustrated in much detail in FIG. 2, the cleaning apparatus 20 including the cleaning blade 12, the paddle wheel 14, and the waste toner container 15 constitutes the photo-sensitive member unit together with the photo-sensitive member drum 4, and it is accomodated in an image forming case 21.

The waste toner container 15 is located next to ther thermal roller fixing apparatus 9.

It is noted from the apparatus according to the present embodiment that there is provided an open space 31 between a wall 20a of the waste toner container 15 at the side of the thermal roller fixing apparatus 9 and a wall 21a of the image forming case 21 at the side thermal roller fixing apparatus 9. Below and above the open space 31 there are provided vent ports 30, so that air is caused to flow in from the opening in the bottom plate of the recording apparatus through the lower vent port 30 and flow upwardly from the upper vent port 30. Furthermore, heat insulation materials 21*b* and 20*b* are applied respectively to the wall 21*a* of the image forming case 21 facing the open space 31 and to the wall 20*a* of the waste toner container 15 at the side of the thermal roller fixing apparatus 9. The walls 20*a* and 21*a* are at opposite sides of the open space 31.

Since the present recording apparatus is constituted as above described, the heat generated at a fixing roller 9-1 of the thermal roller fixing apparatus 9 is effectively shielded from transfer to the waste toner by the air flowing through the open space 31 and the heat insulating materials 21*b*, 20*b* applied respectively to the walls 20*a*, 21*a* of the open space 31 at the opposite sides. Furthermore, since the waste toner in the waste toner container 15 is inhibited from being in direct contact the wall 20*a* of the waste toner container 15, but instead is in direct contact with the heat insulating material 20*b*, heat will hardly be conducted. For the heat insulating material 20*b*, foam material of plastic or the like may be preferably employed.

Figure 3:
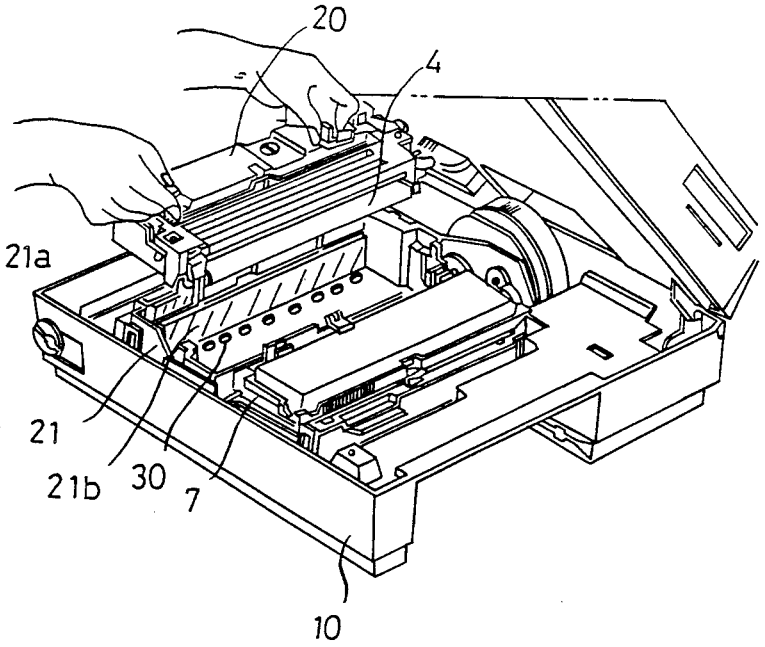
FIG. 3 is a perspective view showing the manner of attachment and detachment of the photo-sensitive member unit.

FIG. 3 illustrates the manner of detaching or attaching the photo-sensitive member unit consisting of the cleaning apparatus 20 and the photo-sensitive member drum 4. In FIG. 3, the heat insulating material 21*b* applied to the wall 21*a* of the image forming case 21 and the vent port 30 provided at the bottom of the open space 31 can be clearly seen.

As explained above, according to the present invention, the heat generated in the fixing apparatus may be comparatively easily prevented from being conducted to the toner contained in the waste toner container of the cleaning apparatus in particular. Accordingly such problems as caking of the toner caused by the toner being overheated in the waste toner container and resultant failure in detecting the level of the toner in the container, as well as poor cleaning and so forth, may be solved. Experiments have shown that application of the present invention has enabled the temperature in the waste toner container to be reduced on the order of 10° C.

What is claimed is:

1. An electrostatic recording apparatus comprising:

(a) a photosensitive member;

(b) first means for supplying toner to said photosensitive member;

(c) a thermally fixing apparatus;

(d) a waste toner container having a first wall on the side of said waste toner container adjacent said thermally fixing apparatus;

(e) second means for discharging waste toner from said photosensitive member to said waste toner container; and (f) an image forming case containing said waste toner container, said image forming case having a second wall on the side of said image forming case adjacent said thermally fixing apparatus, wherein:

(g) an open space is provided between said first wall and said second wall;

(h) vent ports are provided communicating with the top and the bottom of said open space; and (i) heat insulating material is applied to said first wall and to said second wall.

2. A electrostatic recording apparatus as recited in claim 1 wherein said waste toner container is detachably provided in said image forming case.

3. An electrostic recording apparatus as recited in claim 1 wherein said heat insulating material is applied to the side of said first wall opposite to said thermally fixing apparatus.

4. An electrostatic recording apparatus as recited in claim 3 wherein said heat insulating material is applied to the side of said wall opposite to said thermally fixing apparatus.

5. An electrostatic recording apparatus as recited in claim 1 wherein said heat insulating material is applied to the side of said second wall opposite to said thermally fixing apparatus.

* * * * *